United States Patent [19]

Williams, Jr.

[11] Patent Number: 4,907,737

[45] Date of Patent: Mar. 13, 1990

[54] ELECTRONIC CONTROL SYSTEM FOR A GAS-FIRED/HOT AIR FURNACE WITH INDUCED DRAFT BLOWER

[75] Inventor: Roger W. Williams, Jr., Springfield, Mass.

[73] Assignee: R. E. Phelon Company, Inc., East Longmeadow, Mass.

[21] Appl. No.: 331,603

[22] Filed: Mar. 30, 1989

[51] Int. Cl.[4] ..... F24H 3/00

[52] U.S. Cl. ..... 236/11; 236/46 E; 236/DIG. 9; 431/20; 110/162

[58] Field of Search ..... 236/9 R, 9 A, 10, 11, 236/46 E, 46 F, DIG. 9; 110/162; 126/116 A, 110 C; 431/20, 29, 30

[56] References Cited

U.S. PATENT DOCUMENTS

| | | | |
|---|---|---|---|
| 2,230,446 | 2/1941 | Baker | 236/9 A |
| 2,238,000 | 4/1941 | Nessell | 236/9 A |
| 3,454,078 | 7/1969 | Elwart | 236/10 X |
| 3,726,473 | 4/1973 | Sapir | 236/11 |
| 4,773,586 | 9/1988 | Ryan | 236/11 |
| 4,789,330 | 12/1988 | Ballard et al. | 236/9 R X |

*Primary Examiner*—Harry B. Tanner

*Attorney, Agent, or Firm*—Chapin, Neal & Dempsey

[57] ABSTRACT

Electronic control system for a gas-fired/hot air furnace includes a primary control unit which controls the flow of fuel to the furnace. The furnace has heating and cooling space thermostats and a comfort fan to supply heated or cooled air to the space being monitored by the thermostats and an induced draft blower which supplies combustion air into the furnace for heating. A first switch and associated relay drive selectively energizes the comfort fan for low speed heating operation and a second relay switch and associated relay drive selectively energizes the comfort fan for high speed cooling operation. Actuation of the heating thermostat energizes a third switch and associated relay drive which energizes the induced draft blower. A high temperature thermostat located to sense excessive furnace temperatures is also connected to actuate the third relay to energize the induced draft blower in an excessive temperature condition. The high temperature thermostat is also connected to the relay drive of the second relay switch to energize the high speed operation of the comfort fan in the event of excessive furnace temperature.

8 Claims, 2 Drawing Sheets

ELECTRONIC CONTROL SYSTEM FOR A GAS-FIRED/HOT AIR FURNACE WITH INDUCED DRAFT BLOWER

BACKGROUND OF THE INVENTION

This invention relates to a solid-state electronic control system for a furnace or comfort fan and induced draft blower of a gas-fired/hot air furnace. Separate relays are energized and de-energized by heating and cooling space thermostats to selectively energize the comfort fan to low or high speed operation and the induced draft blower which supplies combustion air to the furnace. A high temperature thermostat is disposed to sense the furnace temperature and also provides a control signal to energize the induced draft blower relay and the relay which controls the high speed operation of the comfort fan.

U.S. Pat. No. 4,773,586 to Ryan discloses an electronic control system for a furnace which utilizes a furnace fan operated by a single relay drive driven at one speed in response to either one of two signals received from the space thermostat or from an over-temperature furnace sensing thermostat. The Ryan patent does not disclose separate relays to control the high and low speed operation of the furnace fan nor of using the induced draft blower fan in response to a control signal from the space thermostat and the over-temperature thermostat on the furnace.

U.S. Pat. No. 4,789,330 to Ballard, et al shows a microprocessor controlled system for operating a gas furnace. Thermostats control the operation of an induced draft blower and a two-speed circulating air blower. The furnace flame and thermostat conditions are sensed and the microprocessor thereby determines if the fuel valve may be stuck in "open" position while the thermostat is not calling for heat.

The principal object of this invention is to provide a simple and economical electronic control system for energizing a furnace circulating air fan at low speed in response to a space heating thermostat signal and at high speed in response to a second thermostat which detects an over-temperature furnace condition. Signals from both the over-temperature and the space heating thermostats also energize an induced draft blower to supply combustion air to the furnace.

A further object of this invention is to provide an electronic furnace control system which utilizes air conditioning components of a combined heating and air conditioning system in response to excessive furnace temperatures.

Another object of this invention is to provide an electronic control system, of the above type, which senses excessive furnace temperatures and, in response thereto, energizes both the induced draft blower and the high speed cooling operation of the furnace fan blower, even when the room thermostat is not calling for heat.

The above and other objects and advantages of this invention will be more readily apparent from the following description read in conjunction with the accompanying drawings, in which:

FIG. 1 is a block diagram illustrating an electronic furnace control system of the type embodying this invention, and FIG. 2 is a schematic wiring diagram of the system of FIG. 1 shows in greater detail.

DESCRIPTION OF THE PREFERRED EMBODIMENT

Figure 1:
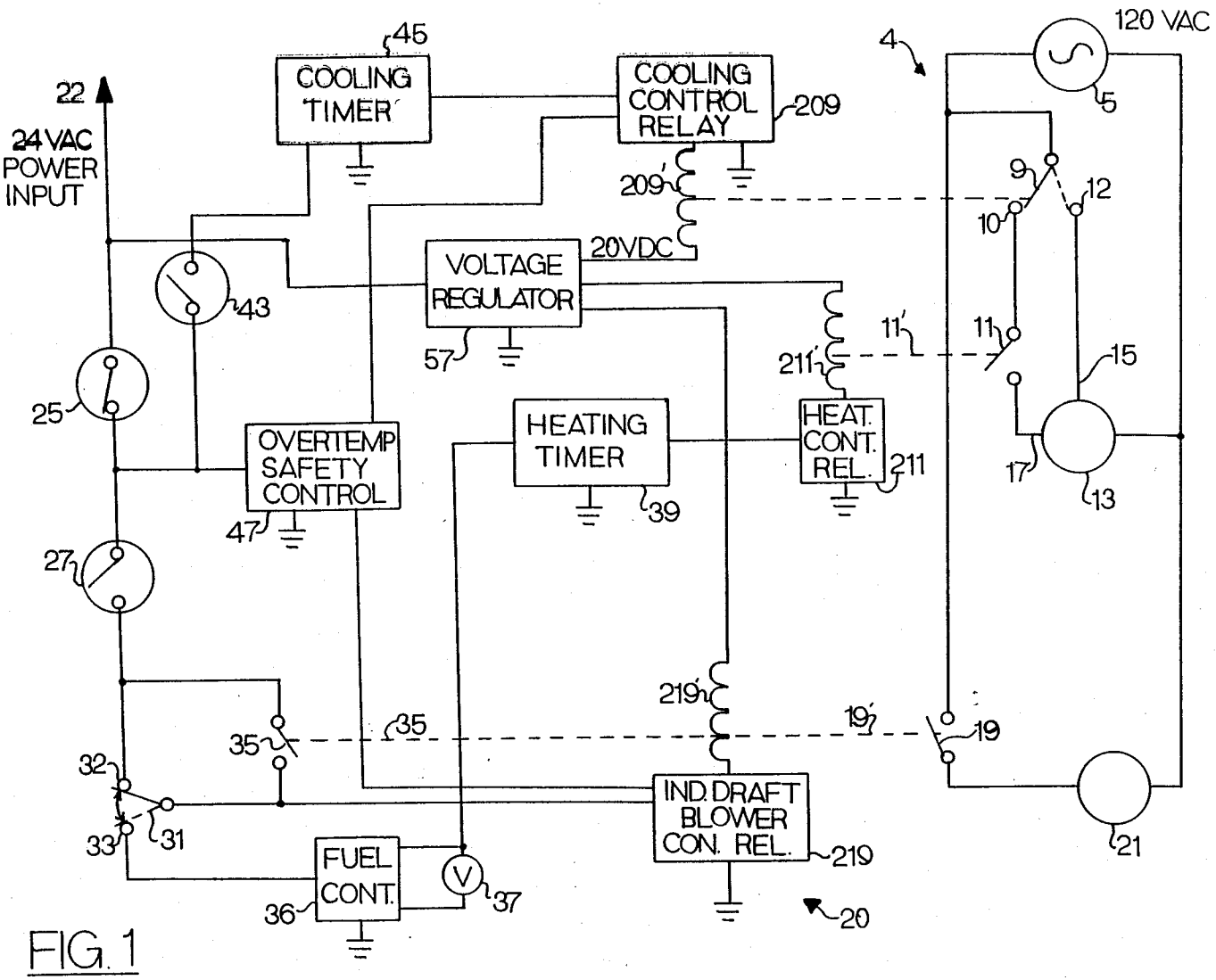

An electronic heating control system indicated generally at 20 is used to operate a gas-fired/hot air furnace and includes a furnace fan, or comfort fan 13 and an induced draft blower 21, both energized by an electrical energy source 5, which, as illustrated, may be a 120 volt alternating current source. The function of the comfort fan is to move air about the periphery of the heat exchanger of the furnace where the air is heated before moving into the room or space being monitored by a heat controlling thermostat 27. The comfort fan 13 includes high and low speed windings which are respectively controlled by separate relay switches 9 and 11. The low speed windings of the comfort fan blower are used to impel heated air into the space to be heated in response to a call for heat from the thermostat 27. The high speed windings are normally used for air conditioning operation when cooled air is called for by cooling thermostat 43 connected to control cooling timer 45. In accordance with this invention, the high speed relay control switch 9 is used to help control excessively high furnace temperatures during heating operation of the furnace. The induced draft blower 21 induces, or draws, combustion air into the furnace for combustion with the fuel, such as natural gas, provided by fuel valve 37 under the control of the fuel control circuit 36. One type of burner control for use in practicing this invention, is a gas control marketed by Minneapolis Honeywell as Model No. S86H 1006.

In addition to the heating thermostat 27 and the cooling thermostat 43, both located in the space to be heated and cooled by the system, an excessive temperature thermostat or "over-temp" switch is provided at the furnace to monitor the temperature of the furnace per se, and to take remedial action to minimize the potential damaging effects of any excessive temperatures. This will be accomplished by turning "ON" the induced draft blower and a high speed operation of the comfort fan. It is the control system 20 which serves to achieve this beneficial result.

The control system 20 acts to operate, selectively, relay switches 9, 11 and 19 in the 120 V.A.C. circuit 4 depending upon temperatures in both the space being monitored by the heating thermostat 27 and the furnace, itself, being monitored by "over-temp" switch 25. Electric power is supplied to the control system 20 by a step-down transformer 7 (FIG. 2) from the 120 volts A.C., supplied to circuit 4, to 24 volts A.C. Diode 53 and voltage regulator 57 transforms this power input to 20 volts D.C. which energizes other electrical components of the system.

The control system 20, as depicted in FIG. 1, comprises a fuel control unit 36 connected to control supply of gas to the furnace by gas valve 37. A vacuum operated air switch 31 energizes control unit 36 when the induced draft blower 21 is running in response to induced draft blower relay drive 219, closing switch 19. An excessive temperature or "over-temp" control 47 is provided to receive a signal from over-temp thermostat 25 and to provide a signal to the induced draft blower relay control 219 and a signal to relay control 209 to actuate relay switch 9. A timer unit 39 is provided to control relay drive 211 which selectively energizes relay switch 11. Broken lines 9' and 11' represent this operational relationship. The timer 39 delays the turn "ON" of the comfort fan 13 for a predetermined time after the gas burner is ignited by a signal from fuel valve 37 as well as the turn "OFF" of the fan 13 for a certain time after the burner is extinguished. A voltage regulator 57 is also included to provide control of the electrical power to a cooling relay control 209, heating relay control 211 and the induced draft blower relay drive 219 which energize solenoid coils 209', 211' and 219', respectively.

Over-temp switch 25 is normally "closed", and "opens" only when the temperature in the furnace, itself, exceeds a predetermined high temperature limit, above those encountered in normal furnace operation such as might occur when the fuel valve 37 is stuck in an "open" position and with the thermostat 27 "open" and not calling for heat. Current is supplied by the normally "closed" over-temp switch 25 lead to normally "open" heating thermostat 27 and cooling thermostat 43.

HEATING OPERATION

When the heating thermostat 27 "closes", indicating that the room temperature is below that set on the thermostat, the control system 20 will energize both the comfort fan blower 13 and the induced draft blower 21, as hereinafter described.

When the heating thermostat 27 initially "closes", current passes through airflow switch 31, which, at that time, would be in its upper, or no airflow position 32, to the induced draft blower relay drive 219 which energizes induced draft blower solenoid coil 219' to "close" switch 19 and relay switch 35. Broken lines 19' and 35' represent the operational relationship between solenoid coil 219' and the relay switches 19 and 35. The induced shaft blower 21 will thus begin to draw combustion air into the furnace. The resulting airflow will cause airflow switch 31 to shift to its lower position 33. As a result switches 35 and 31 will supply power to the fuel control unit 36 and the induced draft blower relay 219 until thermostat 27 reopens.

Energizing fuel control 36 will "open" fuel valve 37 and provide power to the timer circuit 39 which, as previously discussed, delays the turn "ON" and "OFF" of the comfort fan.

Generation of the timer's delayed "ON" signal will energize the heating control relay 211, causing current to flow through heating control relay coil 211', which will "close" heating relay switch 11. Closing heating relay switch 11 will supply current from the 120 V.A.C. power source to the low speed terminal 17 of the comfort fan blower 13. The comfort fan blower will thereafter operate at its low speed until turned "OFF" by operation of relay 9 or 11, connected in series.

COOLING OPERATION

While this control system is utilized to operate a heating system, it is used in combination with cooling relay drive 209. For Summer-time cooling, the normally "open" cooling thermostat 43 will "close" only when the room temperature is above, or warmer, than a desired pre-set limit and energize cooling timer 45 which delays the fan turn "OFF" for a certain time interval after the cooling temperature has cut "OFF". For cooling purposes, when the room temperature is too high, the comfort fan blower 13 will be operated at its higher speed for more efficient movement into the space being cooled of the denser cool air.

This high speed blower operation is utilized in the present heating control system to provide for higher speed and greater volume of airflow about the furnace to more effectively ameliorate an excessively high temperature burner condition. By energizing the cooling control relay coil 209', the cooling relay is switched by switch 9 from its normal low speed position 10 in series with switch 11 to its high speed position 12. Power will thus be supplied by conductor 15 to the high speed windings, instead of the lower speed windings of the comfort fan 13, causing the blower to operate at a high speed.

SAFETY FURNACE OVER-TEMPERATURE OPERATION

Opening the normally "closed" over-temp switch 25 will interrupt current flow to the cooling thermostat 43 and heating thermostat 27 and thereby prevent the normal cooling and heating operations. Normally "closed" over-temp switch 25 will "open" to active over-temp safety control 47 when the furnace temperature exceeds a safe predetermined limit. This would occur when the fuel valve 37 is stuck in an "open" position and the thermostat 27 is not calling for heat. In such event, it is desirable to maintain the flow of air drawn by the induced draft blower 21 into the furnace so that the required air for the gas flame will be satisfied and will not "roll out" of the combustion chamber. When the over-temp safety control 47 is activated, both the cooling control relay 209 which operates the high speed operation of the comfort fan blower and the induced draft blower relay 219 which operates the induced draft blower 21, will be energized. It is important to run the comfort fan blower 13 to dissipate the excess heat as rapidly as possible away from the furnace and into the heated space whereby the occupants may be alerted to the problem.

Figure 2:
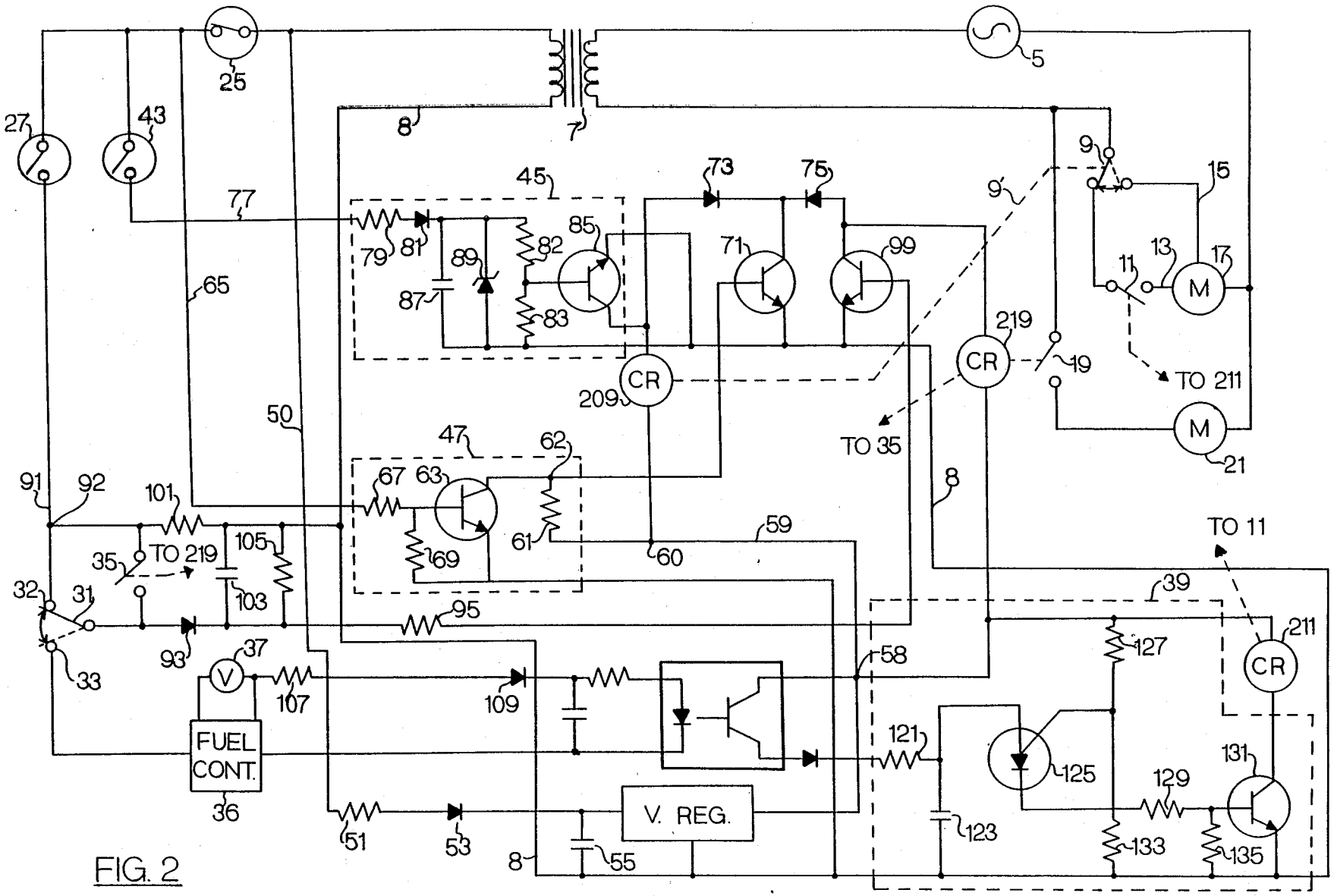

The electronic components of the control system 20, shown and generally described in conjunction with the block diagram in FIG. 1, are illustrated in greater detail in FIG. 2 for a more comprehensive understanding of this invention.

Voltage from transformer 7 is supplied directly to voltage regulator 57 via conductor 50, resistor 51, diode rectifier 53 and capacitor 55.

The direct current output of the voltage regulator is connected to junction 58 from which one conductor supplies power to opto-coupler 114 and conductor 64 connects to control relays 211 and and 219 and a programmable uni-junction transistor or PUT 125 via resistor 127. From junction 58, conductor 59 continues to junction 60 which connects to power control relay 209 to the base of transistor 71 via resistor 61 to control transistor 71, as hereinafter described.

The principal element of the cooling timer 45 is transistor 85 which is controlled by Zener diode 89, capacitor 87 and a voltage divider comprising resistors 82 and 83. Diode 81 and limiting resistor 79 serve to provide a direct current voltage supply to the base of transistor 69.

The over-temp safety control circuit 47 includes transistor 63 with associated resistors 67 and 69. Transistor 63 controls current to the base of, and subsequent activation of, transistor 71, as later described in greater detail. Transistor 71 energizes control relays 209 and 219 through diodes 73 and 75, respectively.

Current is supplied to fuel control 36 by heating thermostat 27, via conductor 91 closed relay switch 35 and airflow switch 31. From switch 35, the current is rectified by diode 93 and connected, via resistor 95 by conductor 97 to the base of transistor 99 which energizes induced draft blower relay drive 219. Resistor 101 connects the thermostat circuit back to ground lead 8 and capacitor 103 and resistor 105 are connected across switch 35.

Activation of the fuel control will simultaneously "open" fuel valve 37 and energize light-emitting diode (LED) 115 of opto-coupler 114. The LED is coupled to the silicon photo-transistor 117 portion of the opto-coupler 114. Activation of the opto-coupler is effected by resistor 107, diode rectifier 109, capacitor 113 and resistor 111. The opto-coupler supplies power to timing circuit 39 via diode 119 and resistor 121.

Timing circuit 39 includes the PUT 125, the resistor 121, capacitor 123 and voltage divider resistors 127 and 133. The output of PUT 125 will energize transistor 131 through resistor 129 and past biasing resistor 135. Resistors 127 and 133 provide a voltage divider network for controlling the operation of PUT 125.

OPERATION

As shown in FIG. 2, transformer 7 supplies 24 volts A.C. via conductor 50, resistor 51, diode 53 to voltage regulator 57 and capacitor 55 smoothes out the rectified input to provide an output of 20 V.D.C. from voltage regulator 57 to supply power to control relay 209, via conductor 59 or through resistor 61 to junction 62 which connects to transistor 63 of over-temp safety control 47 or the base of transistor 71. From junction 58, conductor 64 branches to supply power to both control relays 211 and 219. Junction 58 is also directly connected to supply power to silicon photo-transistor 117 of opto-coupler 114. The direction of current flow from junction 62 is controlled by the transistor 63, as hereinafter described.

Input current through normally "closed" over-temp switch 25 will follow conductor 65 through limiting resistor 67 to the base of transistor 63 whereby the transistor is biased "ON" whenever over-temp thermostat 25 to "closed". When transistor 63 is "ON", current at junction 62 will flow through transistor 63 back to transformer 7 via conductor 8. Current, which through over-temp switch 25, also energizes the heating and cooling thermostats.

Should over-temp switch 25 "open" as a result of an excessive furnace temperature, both control relays 209 and 219 will be energized. Since over-temp switch 25 is "open", no current will be carried by conductor 65 to over-temp circuit 47 and neither the cooling nor heating thermostats will be energized. As a result, transistor 63 will be turned "OFF". Under this condition, the current from junction 62 will be diverted to the base of over-temp control transistor 71, turning "ON" this normally "OFF" transistor. When transistor 71 is conducting, current from control relay 209 through diode 73 will energize this cooling control relay to turn the comfort fan "ON" at high speed. Also, current from relay control 219, through diode 75 and transistor 71, will energize control relay 219 to activate the induced draft blower 21. It will now be recognized that by merely opening thermostat 25, both the induced draft blower and comfort fan, operating at high speed, will be turned "ON" by transistor 71.

In Summer, when the temperature rises above a predetermined limit set on the cooling thermostat 43, the thermostat 43 will "close", directing 24 V.A.C. via conductor 77, to cooling timer 45 which includes limiting resistor 79, diode rectifier 81, voltage divider resistors 82 and 83, capacitor 87 and Zener diode 89 which control operation of transistor 85. When conducting, transistor 85 will energize cooling relay control 209 and its associated switch 9, actuating the high speed cooling operation of comfort fan blower 17. It will be appreciated that for heating operations, that cooling circuit 45 will not be operative, but that transistor 71, when conducting, will achieve the same result of energizing control relay 209.

When normally open, heating thermostat 27 closes and the normally closed over-temp switch is closed, the following sequence will result in activation of both the induced draft blower 21 and the low speed operation of the comfort fan blower 17. Thermostat 27, when closed, will provide a current via conductor 91, junction 92 and airflow switch 31, which is in its no-airflow position 32, since induced draft motor 21 is not yet operating. Current passing through airflow switch 31 continues through diode 93, resistor 95 and conductor 97 to the base of transistor 99. This turns "ON" transistor 99 which energizes control relay 219 which will "close" normally "open" induced draft blower relay switch 19, causing operation of induced draft blower 21. As a result, airflow switch 31 will be moved to its airflow position 33 and switch 35 will be simultaneously closed to maintain current flow to transistor 99, regardless of the position of airflow switch 31. The induced draft blower will thus be energized whenever thermostat 27 calls for heat.

Power for operation of the comfort fan blower 21 will now be supplied via heating thermostat 27, conductor 91, junction 92, "closed" relay supply switch 35 and airflow switch 31 in its airflow position 33 to energize fuel control 36.

The heat control timer circuit 39 operates the heating control relay by the fuel control 36 being energized to cause a current to flow through the light emitting emitting diode 115 of opto-coupler 114, energizing silicon photo-transistor 117. The use of opto-coupler 114 is preferred in this application to isolate the PUT 125 in case of a power surge from the A.C. power supply to the fuel control. The output of the opto-coupler 114 flows through diode 119 and resistor 121 to charge capacitor 123 until its voltage level equals the threshold firing voltage of PUT 126 at which point the PUT 125 will be biased "ON". This time interval provides a first time delay for the build-up of furnace temperature before the comfort fan blower is energized by relay drive 211 controlled by transistor 131 which is turned "ON" when PUT 125 is switched to its conducting mode. Upon an interruption of the signal from the fuel control 36 through the opto-coupler 114, the PUT 126 will be held "ON" until the voltage charge of capacitor 123 is discharged to a voltage level below the threshold firing voltage of PUT 125. As a result, the PUT ceases conducting and will turn transistor 131 "OFF" to de-energize the heating control relay 211. In this manner, the delay in actuating the PUT 125 permits the comfort fan blower to run after the heat thermostat 27 stops calling for heat to enable the comfort fan blower to transfer residual heat into the heated space. The PUT, capacitor 123 and resistor 121, thus serve a dual timing function in a simple, economical but highly effective and reliable manner.

Having thus described my invention, what is claimed is:

1. Solid state control for a gas-fired/hot air furnace which includes a comfort fan blower having windings adapted when energized to drive the fan at high and low speeds and an induced draft blower adapted to supply air into the combustion chamber of the furnace, said control comprising a normally open heating thermostat switch which upon closing, generates a first signal and a normally closed, over-temp control element adapted to open only when the furnace temperature exceeds a predetermined limit, means responsive to the opening of said control element to generate a second signal, means responsive to said first signal to energize both said induced draft blower and the low speed windings of said comfort fan, and means responsive to said second signal to energize the high speed windings of said comfort blower and said induced draft blower.

2. Solid state control for a gas-fired/hot air furnace, as set forth in claim 1, in which said means responsive to said first signal comprises a time-delay circuit energized by an opto-coupler and includes a transistor connected to energize selectively a relay drive for the low speed windings of the comfort fan, a programmable uni-junction transistor (PUT) to control the operation of said transistor and an input circuit which includes a capacitor which operates to delay both the turn "ON" and turn "OFF" of said PUT whereby the comfort fan is correspondingly controlled.

3. Solid state control for a gas-fired/hot air furnace, as set forth in claim 1, in which said means responsive of said second signal comprises a relay drive which is adapted to energize the high speed windings of said comfort fan.

4. Solid state control for a gas-fired/hot air furnace, as set forth in claim 1, in which said means responsive to said second signal comprises a relay control adapted to energize the induced draft blower when the heating thermostat is open and not calling for heat.

5. Solid state control for a gas-fired/hot air furnace, as set forth in claim 3, in which said means responsive to said second signal comprises a relay control adapted to energize the induced draft blower when the heating thermostat is "open" and not calling for heat.

6. Solid state control for a gas-fired/hot air furnace, as set forth in claim 5, in which said means responsive to said second signal comprises a first, normally conducting transistor, which is held "ON" by said over-temp control element and is connected in circuit with a second transistor which is turned "ON" when the first transistor is "OFF", said second transistor being connected in circuit with a relay drive to energize the high speed windings of the comfort fan.

7. Solid state control for a gas-fired/hot air furnace, as set forth in claim 6, in which said second transistor is also connected to a control relay which energizes the induced draft blower and when turned "ON", said second transistor energizes said induced draft blower as well as the relay drive for the high speed windings.

8. Solid state control for a gas-fired/hot air furnace, as set forth in claim 7, in which said hot-air furnace is also controlled by a cooling system and in which said relay drive is the cooling relay drive of said cooling systems whereby separate relays energize the high and low speed windings of the comfort fan.

* * * * *